US008129605B1

(12) United States Patent
Ursulich

(10) Patent No.: US 8,129,605 B1
(45) Date of Patent: Mar. 6, 2012

(54) FRONT F, ALTISSIMO G KEY FOR SAXOPHONE

(76) Inventor: Ralph William Ursulich, Orem, UT (US)

( * ) Notice: Subject to any disclaimer, the term of this patent is extended or adjusted under 35 U.S.C. 154(b) by 0 days.

(21) Appl. No.: 12/885,761

(22) Filed: Sep. 20, 2010

(51) Int. Cl.
*G10D 7/00* (2006.01)

(52) U.S. Cl. ..... 84/380 R

(58) Field of Classification Search ..... 84/380 R, 84/330, 385 R, 342–345, 376 K, 387 R
See application file for complete search history.

(56) References Cited

U.S. PATENT DOCUMENTS 638,385 A 12/1899 Evette
7,741,555 B2 * 6/2010 Onozawa ..... 84/653

OTHER PUBLICATIONS

This link will take you to Pro-Music-News, W ind-Section Feb. 2001. Selmer (Paris) Super Action Series III alto saxophone Model 62H with altissimo G key. They call it the harmonic key http://pro-music-news.com/html/11/e10211se.htm.
This link will take you to Selmer (Paris) official web site, a specification page Series III Model 62H, under extended range, Harmonic mechanism solidifies altissimo G. http://www.selmer.com/content/sax_chart.php.
This is the best description of the Selmer 62h harmonic key and operation. The forum Sax on the Web. http://forum.saxontheweb.net/showthread.php?6185-Selmer-series-3-alto-with-3rd-oct.-key.

* cited by examiner

*Primary Examiner* — Kimberly Lockett

(57) ABSTRACT

A key mechanism is specifically for a Saxophone which replaces the current Front F key (5) with a new key called Front F, altissimo G key (8, 8*a*). This key retains the functions of the standard Front F key (5) that allows a player to perform the altissimo F and E notes. The Altissimo G key (8*a*) is incorporated into the new Front F key (8) which allows the player to rapidly perform the difficult altissimo G note.

12 Claims, 5 Drawing Sheets

Figure 1:
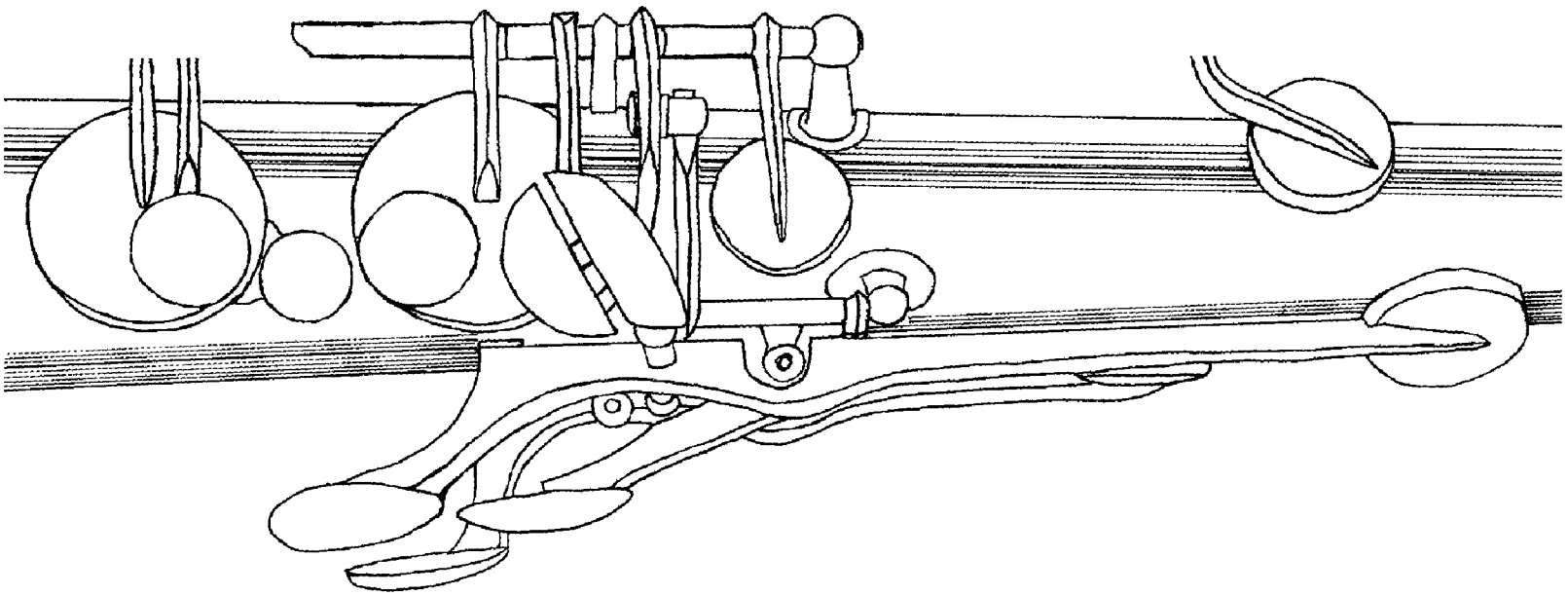

Paul Evett
US Patent
638,385

FRONT F, ALTISSIMO G KEY FOR SAXOPHONE

This Application claims benefit of PROVISIONAL PATENT: No. 61/277,671 filing date Sep. 28, 2009

FEDERALLY SPONSORED RESEARCH

Not Applicable

SEQUENCE LISTING

Not Applicable

BACKGROUND OF THE INVENTION

In the history of the development of the saxophone, there have been many improvements to the key mechanisms for the purpose of allowing the player to more easily perform difficult technical passages in the musical literature. One of the most significant improvements related to the fingering of the two highest notes in the conventional range of the saxophone was the addition of the key by Paul Evette in 1899, U.S. Pat. No. 638,385. Commonly known today as the Front F Key or Auxiliary high F key. Prior to that improvement, the only means of playing the saxophones third octave E (also E3 or altissimo E) was to press open the two lowest left palm keys while pressing the octave key, and adding the topside key touch piece with the right hand. The only way to play the third octave high F was to press open all three of the left hand palm keys while pressing the octave key, and adding the top side key touch with the right hand. By using Evettes Front F Key the note high F could be produced by simply adding the Front F Key to the regular fingering for high C, which consists of the second finger and thumb of the left hand. The note high E could be produced by adding the third finger of the left hand to the aforementioned fingering. This adaptation proved to be especially useful in arpeggios when going between high C and high F, or high C and high E.

The Use of the Altissimo Register

The saxophone, as first designed by Adolphe Sax and patented in 1846, had a conventional playing range extending from written B to F3. In 1881, additional key work was added which allowed the instrument to play down to a written Bb, which has since come to define the conventional range of the instrument from Bb to F3, comprising just over two and one half octaves. While notes going above this conventional two and one half octave range were experimented with by several players, including Adolphe Sax himself in the late 1800s, the study and use of what has come to be called the altissimo register, did not begin in earnest until the early 1900s. Records exist of several American saxophonists from that era who ventured beyond the conventional high F3 into the altissimo register. The most notable of these was the saxophone virtuoso Sigurd Rascher, who in 1928 began performing extensively in the altissimo range, and actively sought to educate others and to pass down this acquired skill. As a result of his pioneering efforts, playing into the altissimo range on all sizes of saxophones has since evolved into a common performance practice in all styles of music, and has become a required skill for all serious students of the saxophone.

Altissimo Fingerings

In general, special cross-fingerings and oral cavity manipulations are used to play the notes of the altissimo register of the saxophone. Paradoxically, the notes G3 and G#3, that are very close to the conventional range of the saxophone, are among the most difficult notes to produce for players attempting to learn the skill. The most common fingerings used to play these difficult notes involve the use of the Front F Key. Eugene Rousseau, Professor Emeritus of Music at Indiana University, has established himself as one of the worlds leading saxophone performers and teachers. Professor Rousseau over a period of many years, has instructed his students in methods to adjust the Front F Key to open the Palm F Key pad a distance much less than its normal opening, in order to facilitate playing these difficult notes in the altissimo range. Rousseaus explanation for why this works is given in his book Saxophone High Tones MMB 1978. As described, when the key opening is lowered to approximately 0.25 mm, the Palm F Key pad takes on the function of a vent similar to the two octave vent tubes that exist on all saxophones, this allows the player to perform notes G3, G#3 more easily. This technique has been highly successful, and has become a part of the methodology of teaching students to play in the altissimo range in many secondary schools and universities. The only shortcoming to the approach espoused by Rousseau is that by mechanically modifying the Front F Key to the small opening of the Palm F Keypad, it causes the notes in the conventional range that require the use of this key to suffer. As a result of the small opening of the Palm F Key pad, the F3 note in the conventional range produced with this fingering, lacks a clear and full tone, and the E3 that uses this fingering is muffled to such a degree that the note becomes musically unusable. In other words, the saxophonist is forced to choose the traditional Front F Key or the modified Front F Key, but not both.

On the Alto Saxophone, an experienced performer with lessons and many hours of practice can play altissimo G note. The preferred embodiment will greatly improve and ease the transition between the saxophone regular range and the altissimo range. It will also aid in clearer articulation of the Altissimo G note with much less effort, better intonation, and provides alternate fingerings for trills.

On the Tenor Saxophone experienced performers find it is much more difficult to play the Altissimo G note. Professional players can force an Altissimo G that is harsh, often weak and off pitch. Some Tenor Saxophone players omit Altissimo G note from their music or avoid music that has altissimo G notes. The preferred embodiment will greatly improve and ease the transition between the saxophone regular range and the altissimo range. It will also aid in clearer articulation of Altissimo G note, with much less effort, better intonation, and provides alternate fingerings for trills.

BRIEF SUMMARY OF THE INVENTION

It is the object of the Preferred Embodiment to give the performer the advantage of using the Palm F Key pad with a small opening, to act as a vent in order to better play the more difficult altissimo G note. In addition pressing the same key mechanism in a different location on its surface affects a full opening (approximately 4 mm) of the Palm F Keypad. This takes advantage of the traditional Front F Key function, allowing the player to perform the notes altissimo F and E.

BRIEF DESCRIPTION OF THE SEVERAL VIEW OF THE DRAWINGS

FIG. 1 is a front view of Preferred Embodiment, top half of Tenor Saxophone

Figure 2:
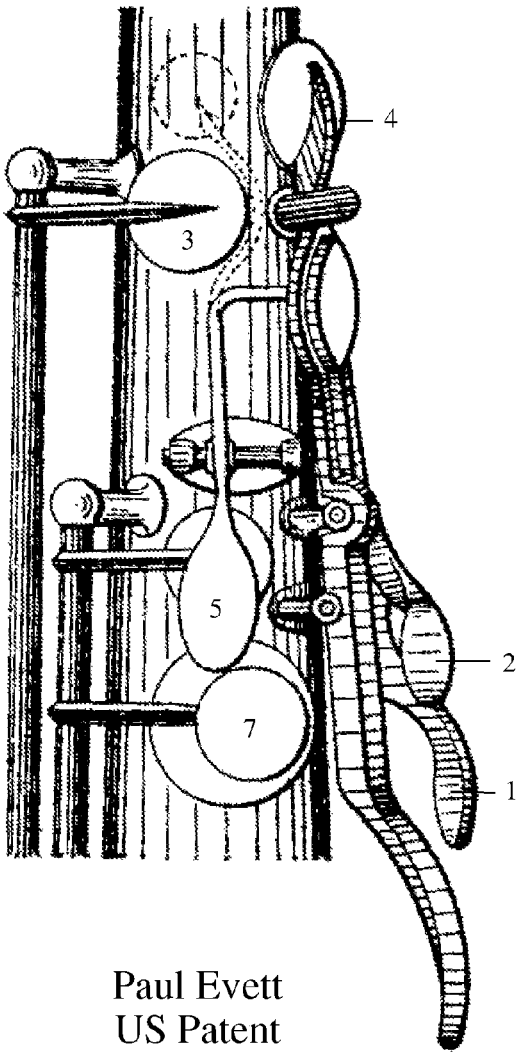
Prior Art Fig. 2
Figure 3:
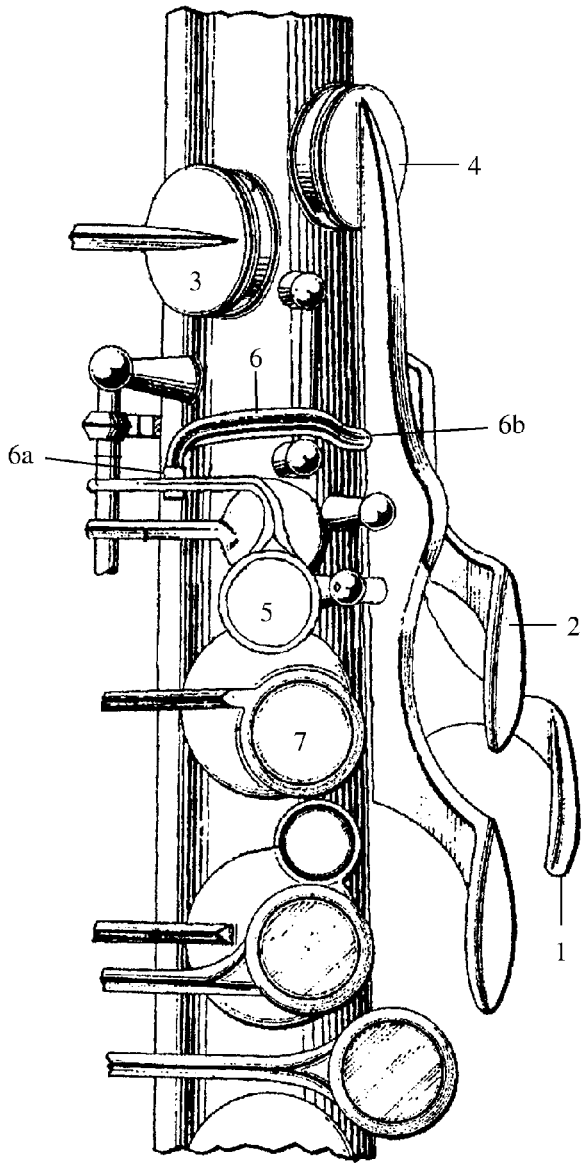
Figure 7:
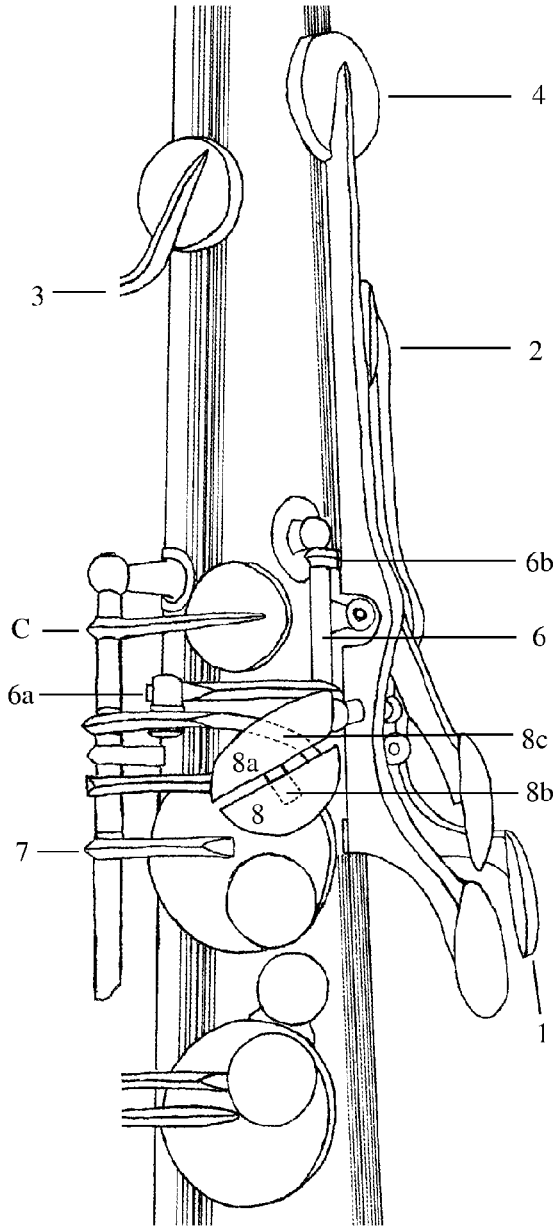
Figure 8:
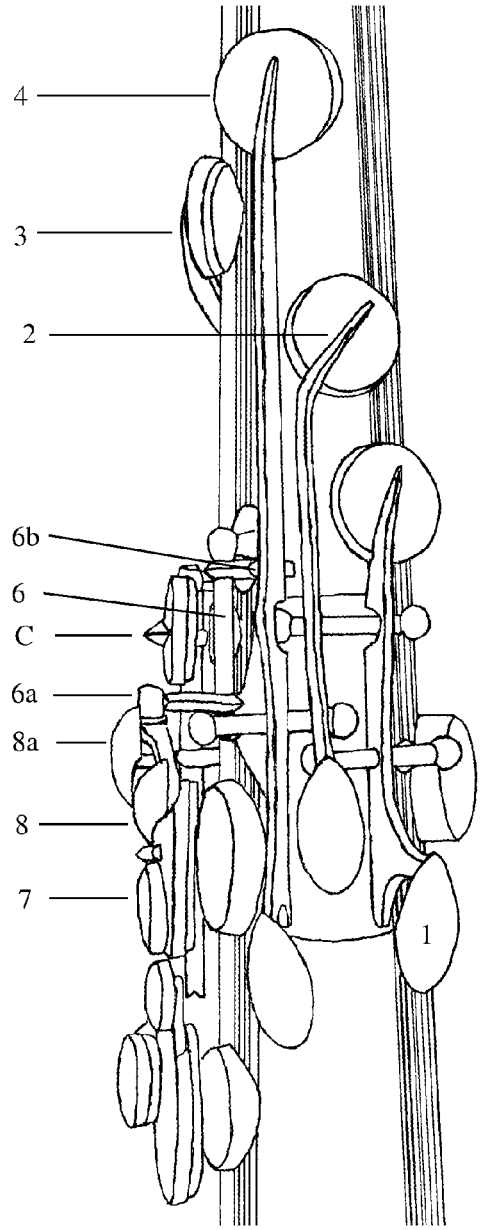
Figure 10:
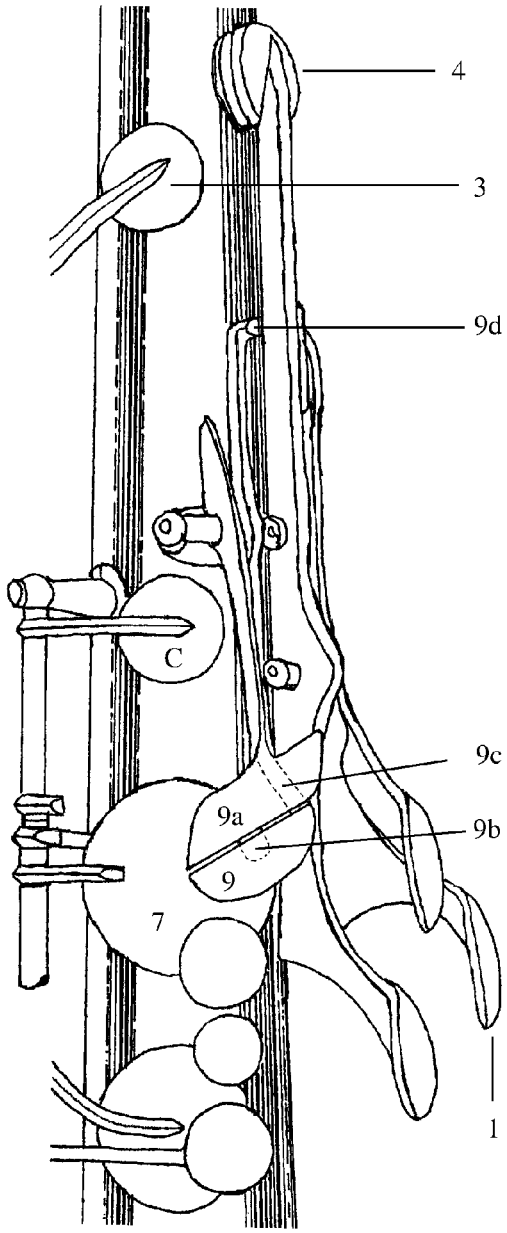
Figure 11:
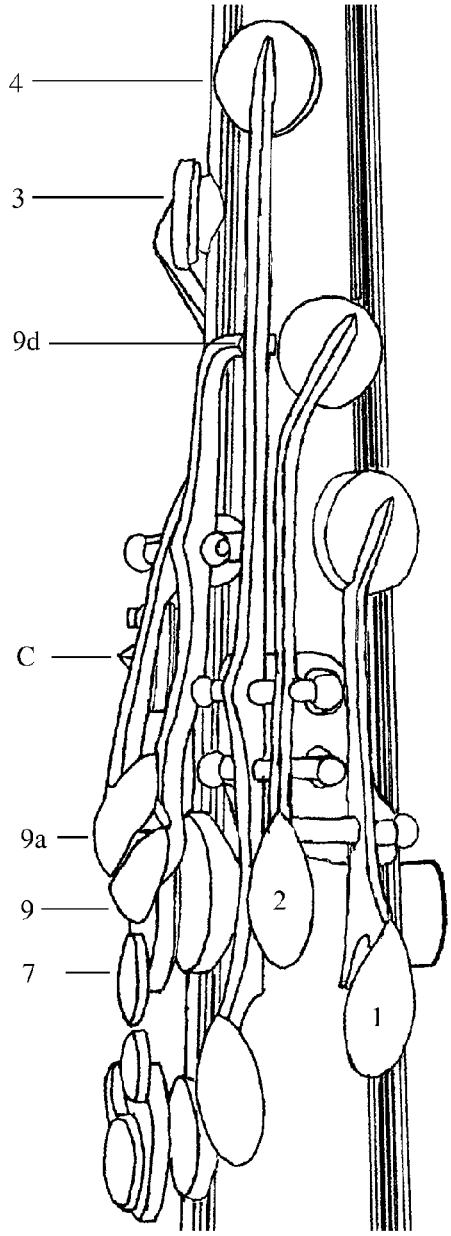
Figure 13:
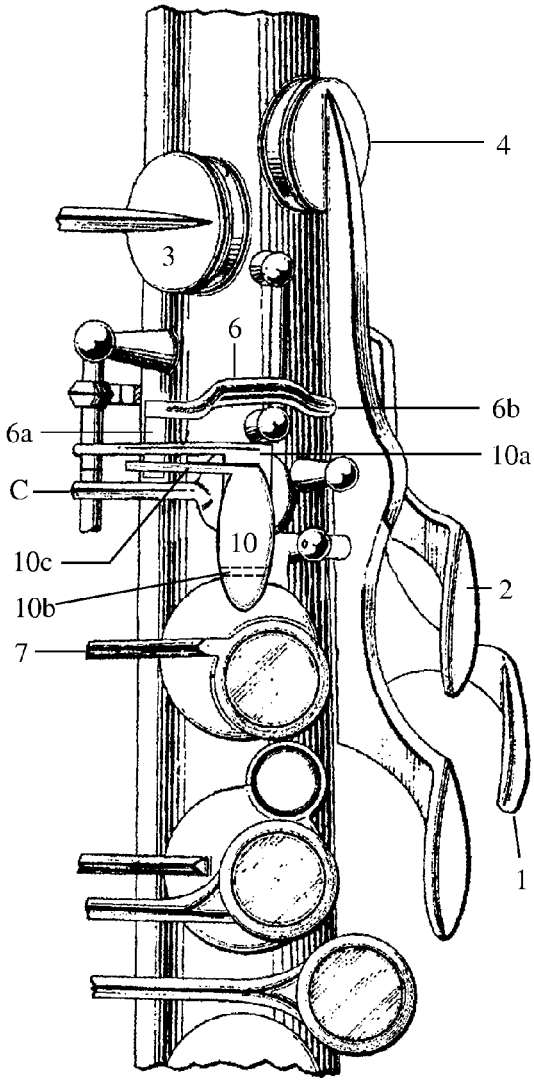
Figure 14:
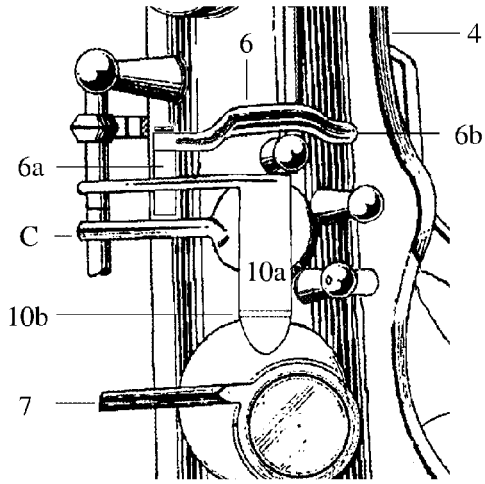
Figure 15:
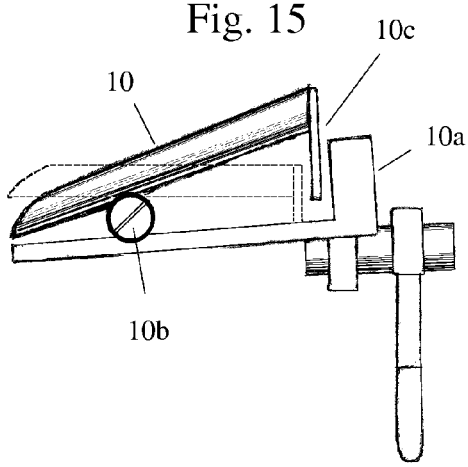

FIG. 2 is a front view of Prior art, Paul Evette, top half of Alto Saxophone FIG. 3 is a front view of Prior art, top half of Alto Saxophone FIG. 7 is a front view of Preferred Embodiment, top half of Tenor Saxophone FIG. 8 is a side view of Preferred Embodiment, top half of Tenor Saxophone FIG. 10 is a front view of Preferred Embodiment, top half of Tenor Saxophone, Variant One FIG. 11 is a side view of Preferred Embodiment, top half of Tenor Saxophone, Variant One FIG. 13 is a front view of Preferred Embodiment, top half of Alto Saxophone, Variant Two FIG. 14 is a front view of Preferred Embodiment, top half of Alto Saxophone, Variant Two FIG. 15 is a side view of Preferred Embodiment, Variant Two

DETAILED DESCRIPTION OF THE INVENTION

In the illustrated saxophone, well known and conventional parts have been omitted, and the description thereof has also been omitted in order not to obscure the novel construction of the present embodiment. First a description of Prior Art, the Preferred Embodiment and then variants one and two of the Preferred Embodiment, called the Front F, altissimo G Key.

PRIOR ART

The Prior Art drawing in FIG. 3 is a version of the original key invented by Paul Evette in 1899, U.S. Pat. No. 638,335. Commonly known as Front F key or Auxiliary high F key. This Front F key (5) is hinged the on upper stack long screw (rod), with an additional Auxiliary lever key (6) with contact points (6*a* and 6*b*). When the Front F key (5) is pressed it closes the B key (7) and C key, while simultaneously pushing contact point (6*a*) on Auxiliary lever key (6) which opens the Palm F key (4) approximately 4 mm at contact point (6*b*). This allows player to perform altissimo F and E notes. This has been the standard for over 100 years.

PREFERRED EMBODIMENT

The drawing in FIG. 7 and FIG. 8 is the Preferred Embodiment on Tenor Saxophone. The key is hinged from the main upper stack rod. This is typically the industry standard.

When the Front F key spatula (8) is pressed it closes the B key (7) and C key and simultaneously contacts (6*a*) on the Auxiliary key (6) which opens the Palm key F (4) approximately 4 mm at contact point (6*b*). This allows the player to perform altissimo F and E notes. When the Altissimo G key spatula (8*a*) is pressed it has a foot (8*b*) which closes the B key and C key. As the Altissimo G key travels it pushes the Front F key arm (8*c*) and simultaneously contacts (6*a*) on the Auxiliary key (6) which opens the Palm key F (4) approximately 1 mm (0.5 to 1 mm) at contact point (6*b*). This allows player to easily perform altissimo G note.

Variant Number One of the Preferred Embodiment

The drawing in FIG. 10 and FIG. 11 is the Preferred Embodiment on Tenor Saxophone, variant number one. This design is closest to Paul Evetts original key, in FIG. 2, invented 1899, U.S. Pat. No. 638,335. This key is between the palm key and upper stack keys. This hinge is turned 90 degrees from upper stack rod which puts it inline with the palm key rods.

When the Front F key spatula (9) is pressed it closes the B key (7) and C key and simultaneously opens the Palm key F (4) approximately 4 mm at contact point (9*d*). This allows the player to perform altissimo F, and E notes. When the Altissimo G key spatula (9*a*) is pressed, it has a foot (9*b*) which closes the B key (7) and C key. As the Altissimo G key (9*a*) travels it contacts the Front F key arm (9*c*) and simultaneously opens the Palm key F (4) approximately 1 mm (0.5 to 1 mm) at the contact point (9*d*). This allows the player to easily perform altissimo G note.

Variant Number Two of Preferred Embodiment

The drawings in FIG. 13, FIG. 14 and FIG. 15 is the Preferred Embodiment on a Alto Saxophone, variant number two. This Front F key (10) is hinged from the main upper stack rod.

For clarity I will describe the function of the Base Key (10*a*) and Touch piece (10) separately. In FIG. 14 when the Base key (10*a*) is pressed it closes the B key (7) and C key while simultaneously pushing the contact point (6*a*) on Auxiliary lever key (6) which opens Palm F key (4) approximately 0.25 to 1 mm at contact point (6*b*). This allows the player to perform altissimo G note with much less effort. The preferred embodiment is shown in FIG. 13. The Touch piece (10) is attached to the Base Key (10*a*) byway of a hinge (10*b*) approximately ⅓ from the tip. At the top of the Touch piece (10) there is an arm (10*c*) which extends over the contact point (6*a*). This allows for an independent push on the contact point (6*a*). When the player presses the Touch piece (10) at the top of key, it also pushes the Base key (10*a*) which closes the B key (7) and C key while simultaneously the arm (10*c*) pushes the contact point (6*a*) on the Auxiliary lever key (6) which opens Palm F Key (4) approximately 4 mm at contact point (6*b*). This allows the player to perform altissimo F, and E notes.

The combination of the Touch piece (10) with the Base key (10*a*) allows a player to choose altissimo F by simply pressing the top of the Touch piece (10) or choose altissimo G by sliding down the Touch piece (10) past the hinge (10*b*) to the tip of the Touch piece (10) (on top of B key 7). The player can choose either position at will with no limitations.

It should be noted that the natural material used in the construction of a saxophone pad can vary. Leather quality, felt density, cardboard, adhesive, and age of a pad can be affected by temperature, humidity and finger pressure. The optimal pad opening for altissimo E, F, G, and G# vary according to the player and the instrument. Therefore the pad openings are expressed in a range, for altissimo E and F notes, about 4 mm to 5 mm. For altissimo G note, about 0.25 mm to 1 mm pad opening. The instrument should be adjusted for the player. One of the previous variants will operate on a majority of current and vintage saxophone configurations.

Although this embodiment has been described in its preferred form with a certain degree of particularity, it is understood that the present disclosure of the preferred form has been made by way of example. Numerous changes in the details of construction, combination and arrangement of parts may be resorted to without departing from the spirit and scope of the embodiment.

REFERENCE NUMERALS

1 Palm D key
2 Palm Eb key
3 Side E key
4 Palm F key

5 Front F key, traditional
6 Auxiliary key or Rocker key
6*a* Contact point on Auxiliary key (6)
6*b* Contact point on Auxiliary key (6)
7 B key
8 Front F key of Preferred Embodiment, Tenor Saxophone
8*a* Altissimo G Key of Preferred Embodiment
8*b* Foot of Altissimo G Key (8*a*)
8*c* Contact point on arm of Front F key (8)
9 Front F key of Preferred Embodiment, Tenor Saxophone, Variant One
9*a* Altissimo G key of Preferred Embodiment
9*b* Foot of Altissimo G key (9*a*)
9*c* Contact point on arm of Front F key (9)
9*d* Contact point on Front F key (9)
10 Front F key Touch piece of Preferred Embodiment, Variant Two
10*a* Base key of Preferred Embodiment
10*b* Hinge on Base key (10*a*)
10*c* Arm on top of Front F Touch piece (10)

Operation of the Invention

Preferred Embodiment and Variant Number One

A player will find the Preferred Embodiment in FIG. 7, FIG. 8, FIG. 10 and FIG. 11, familiar in appearance, touch and location when compared to the triditional Front F key (5). The player operates the Front F key (8 or 9) with left index finger pressing down to close the B key (7) and C key which opens the Palm key F (4) about 4 mm to perform altissimo F and E notes as expected. If the player wants to perform Altissimo G note, they can either slide up or lift and press down on the Altissimo G key (8*a* or 9*a*) to close the B key (7) and C key, which opens the Palm key F (4) about ½ mm. The player can slide up or down at will on the Front F key (8 or 9) or the Altissimo G key (8*a* or 9*a*). They can also rest on the Altissimo G key (8*a* or 9*a*) to operate the Front F key (8 or 9) with the tip of the index finger. Both Front F keys (8 or 9) wrap around the front of the B key cup (7) which allows use of the knuckle to press the Front F key (8 or 9) without moving the finger tip from the pearl of the B key (7).

Variant Two of the Preferred Embodiment

A player will find the Preferred Embodiment in FIG. 13, FIG. 14 and FIG. 15, familiar in appearance, touch and location when compared to the triditional Front F key (5). This Front F key (10, 10*a*) has a rocking motion. When the player wants to perform altissimo F and E notes, they press the top of the Front F touch piece (10) with the left index finger, it closes the B key (7) and C key which opens the Palm key F (4) about 4 mm. To perform altissimo G note, the player can slide the left index finger down or lift and press the tip of the same Front F touch piece (10), it closes the B key (7) and C key which open the Palm key F about ½ mm.

This allows the player to perform altissimo G note effortlessly. It almost pops out. The player can easily slide between altissimo F and G notes at will.

I claim as my invention:

1. A wind musical instrument for selectively producing acoustic tones, comprising:

a tubular instrument body defining a vibratory column of air therein;

a wind inlet piece connected to the tubular instrument body, and blown by a player for vibrations of the vibratory column of air;

a plurality of openings through surface of said tubular instrument body into said vibratory column of air, a key mechanism provided on surface of said tubular instrument body, including plural component parts for selectively closing or venting the openings in said tubular instrument body by the player for specifying a pitch of the acoustic tones, the interaction of selected ones of the plural component parts, a primary key, a secondary key, a tertiary key, a supplemental key and a lever with respective moveable parts and respective stationary parts on said tubular instrument body.

2. The wind musical instrument as set forth in claim 1, in which said player can use variable venting over said openings of said tubular instrument body by means of the key mechanism for manipulating said vibratory column of air.

3. The wind musical instrument as set forth in claim 2, wherein said player can directly finger a plurality of venting over a single said opening in said tubular instrument body by means of preferred embodiment three of said key mechanism.

4. The wind musical instrument as set forth in claim 2, in which said player can use said variable venting on single said opening in said tubular instrument body by means of said key mechanism at a predetermined said venting.

5. The wind musical instrument as set forth in claim 4, in which said player can use said variable venting on the tertiary key said opening in said tubular instrument body by means of said key mechanism at a predetermined said venting sufficient to facilitate altissimo g pitch of said acoustic tones.

6. The wind musical instrument as set forth in claim 4, in which said player can use said variable venting on said tertiary key opening in said tubular instrument body by means of said key mechanism at a predetermined said venting sufficient to facilitate altissimo f pitch of said acoustic tones.

7. The wind musical instrument as set forth in claim 5, in which said key mechanism includes the primary key directly manipulated by said player that closes two said openings in said tubular instrument body while simultaneously vents said tertiary key said opening by means of said key mechanism at a predetermined said venting sufficient to facilitate the altissimo g pitch of said acoustic tones, whereby allowing said player to perform the difficult said altissimo g pitch of said acoustic tones.

8. The wind musical instrument as set forth in claim 6, in which said player press the supplemental key and the secondary key that closes two said openings in said tubular instrument body while simultaneously vents said tertiary key said opening by means of said key mechanism at a predetermined said venting sufficient to facilitate the altissimo f pitch of said acoustic tones.

9. The wind musical instrument as set forth in claim 7, in which said player can finger touch piece of said primary key or said secondary key with other said key mechanism combination that closes two said openings in said tubular instrument body while simultaneously use said variable venting over said tertiary key said opening by means of said key mechanism at two different predetermined said venting sufficient to facilitate the said altissimo g or said altissimo f pitch of said acoustic tones, thereby manipulating said vibratory column of air, whereby said player can rapidly perform the difficult said altissimo g and said altissimo f pitch of said acoustic tones.

10. The wind musical instrument as set forth in claim 3, further includes said player that can press tip or apex of touch piece of said primary key of preferred embodiment three, with other said key mechanism combination that closes two said openings in said tubular instrument body while simultaneously use said variable venting over said tertiary key said opening by means of said key mechanism at two different predetermined said venting sufficient to facilitate said altissimo g or said altissimo f pitch of said acoustic tones, thereby manipulating said vibratory column of air, whereby said player can rapidly perform the difficult said altissimo g or said altissimo f pitch of said acoustic tones and said player can also specify a plurality of said venting over a single said opening.

11. The wind musical instrument as set forth in claim 9, in which said player press said primary key with other said key mechanism combination can trill said altissimo g, said altissimo f and altissimo f sharp pitch of said acoustic tones without said supplemental key or said secondary key, whereby giving said player an alternate fingering for a difficult said key mechanism combination.

12. The wind musical instrument as set forth in claim 9, wherein said player use of said variable venting over said opening of said tubular instrument body by means of said key mechanism improves intonation, pitch control and clarity of altissimo notes of said acoustic tones.

* * * * *